US008342990B1

(12) United States Patent
Price

(10) Patent No.: US 8,342,990 B1
(45) Date of Patent: Jan. 1, 2013

(54) ARROW SWITCHED LIGHTED ARROW NOCK ASSEMBLY

(76) Inventor: Ivan Eric Price, Yates City, IL (US)

( * ) Notice: Subject to any disclaimer, the term of this patent is extended or adjusted under 35 U.S.C. 154(b) by 68 days.

(21) Appl. No.: 12/655,294

(22) Filed: Dec. 29, 2009

(51) Int. Cl.
*F42B 6/06* (2006.01)

(52) U.S. Cl. ..... 473/586; 473/570

(58) Field of Classification Search ..... 473/570, 473/578, 586
See application file for complete search history.

(56) References Cited

U.S. PATENT DOCUMENTS 4,340,930 A * 7/1982 Carissimi ..... 362/204
4,421,319 A * 12/1983 Murphy ..... 473/570
5,134,552 A * 7/1992 Call et al. ..... 362/203
6,736,742 B2 5/2004 Price
7,837,580 B2 * 11/2010 Huang et al. ..... 473/570

* cited by examiner

*Primary Examiner* — John Ricci
(74) *Attorney, Agent, or Firm* — James B. Golden; Golden's M&I

(57) ABSTRACT

This invention relates generally to a nock assembly that is illuminated and more particularly to a nock assembly that has a power source that is removable from the nock assembly for use with an electrically conductive arrow shaft having a nock, illumination member, conductor, and a power source. The illumination member and conductor are in electrical communication with the power source. The power source is in removable engagement with the nock. The principle use is for archers however other applications will benefit from this invention. For example, emergency locators and outdoor lighting displays will benefit from this invention.

15 Claims, 4 Drawing Sheets

ARROW SWITCHED LIGHTED ARROW NOCK ASSEMBLY

TECHNICAL FIELD

This invention relates generally to a nock assembly that is illuminated and more particularly to a nock assembly having a power source that is removable from the nock assembly.

BACKGROUND ART

Archer's equipment, such as, nocks and arrows are being designed to provide archers the ability to track the flight of the arrow. The ability to track the flight of an arrow allows adjustments to be made to the equipment being used and also understand arrow dynamics. Illumination of the archer's nock and/or arrow provides visual feedback to the archer with respect to balance, bow string alignment, and the like. Having this feedback allows the archer to adjust his equipment based on the flight of the arrow. In the field, the archer using illuminated nock and/or arrow will receive immediate feedback with regard to wind dynamics, obstacles, and the like. Having this feedback in the field allows archers to make modifications that increase their ability to hit the desired target.

One problem with previous lighted nock designs relate to longevity and useful life of the nock assembly. In particular, the power source typically used with lighted nock assemblies are optimized to be light weight, i.e. smaller, to overcome weight issues that may affect the flight of the arrow and robustness of the nock assembly upon impact of the arrow. A light weight power source may leads to a minimum operating life of the lighted nock and frequent replacement of the entire lighted nock assembly Another problem inherent with illuminated nock and/or arrow is that the weight of the components required that provide illumination of the nock and/or arrow adversely affect the devices robustness. It has been found that excessive forces acting on an arrow and its illuminating component upon release, during flight and on impact may adversely affect its operation and useful life. The importance of reducing complexity and weight to minimize those forces is paramount. It is for these reasons that emphasis has been placed over the past several years on new designs for manufacturing an illuminated nock and/or arrow capable of withstanding higher arrow velocities generated by technological advances in an archer's equipment, while minimizing affect on accuracy.

The present invention is directed to overcoming one or more of the problems set forth above.

DISCLOSURE OF THE INVENTION

In one aspect of the instant invention, a nock has a first nock portion, a second nock portion, and a step surface located between the first nock portion and the second nock portion. The first nock portion has a first end, a nock bore defined by a first curvilinear surface and a longitudinal axis, and at least one aperture disposed in the first nock portion generally adjacent to the step surface and opening into the nock bore. A power source has a case generally engaging the first nock portion and a terminal. The power source is in generally removable engagement with the nock. An illumination member has a pair of leads. The illumination member is disposed in the nock bore, and one of the pair of leads extends through one of the at least one aperture and another of the pair of leads is in electrical communication with the terminal of the power source. And a conductor is in electrical communication with the case and extends from the nock bore to an outer surface of the nock.

In another aspect of the present invention, a method of servicing a nock assembly for use with an electrically conductive tubular arrow and the nock assembly has a first nock portion and a power source that generally engages the first nock portion. The method comprises the steps of grasping the nock assembly and the power source. Disengaging the power source from the nock assembly. And inserting another power source into the first nock portion of the nock assembly.

In yet another aspect of the present invention, a method of maintaining operability of a nock assembly upon impact of an arrow with a target. The arrow has a tubular arrow shaft has a bowstring defining an aiming position and a resilient impact member disposed therein. The nock assembly has a first nock portion, a second nock portion, a step surface located between the first and second nock portions, a slot defined therein, and a power source that has a resilient member disposed thereabout. The method comprises the steps of inserting the first nock portion into the arrow shaft. Positioning the bowstring in the slot. Drawing the bowstring to the aiming position. Releasing the bowstring. Impacting the arrow with the target. And compressing the resilient member against the first nock portion of the nock assembly.

BEST MODE FOR CARRYING OUT THE INVENTION

Figure 1:
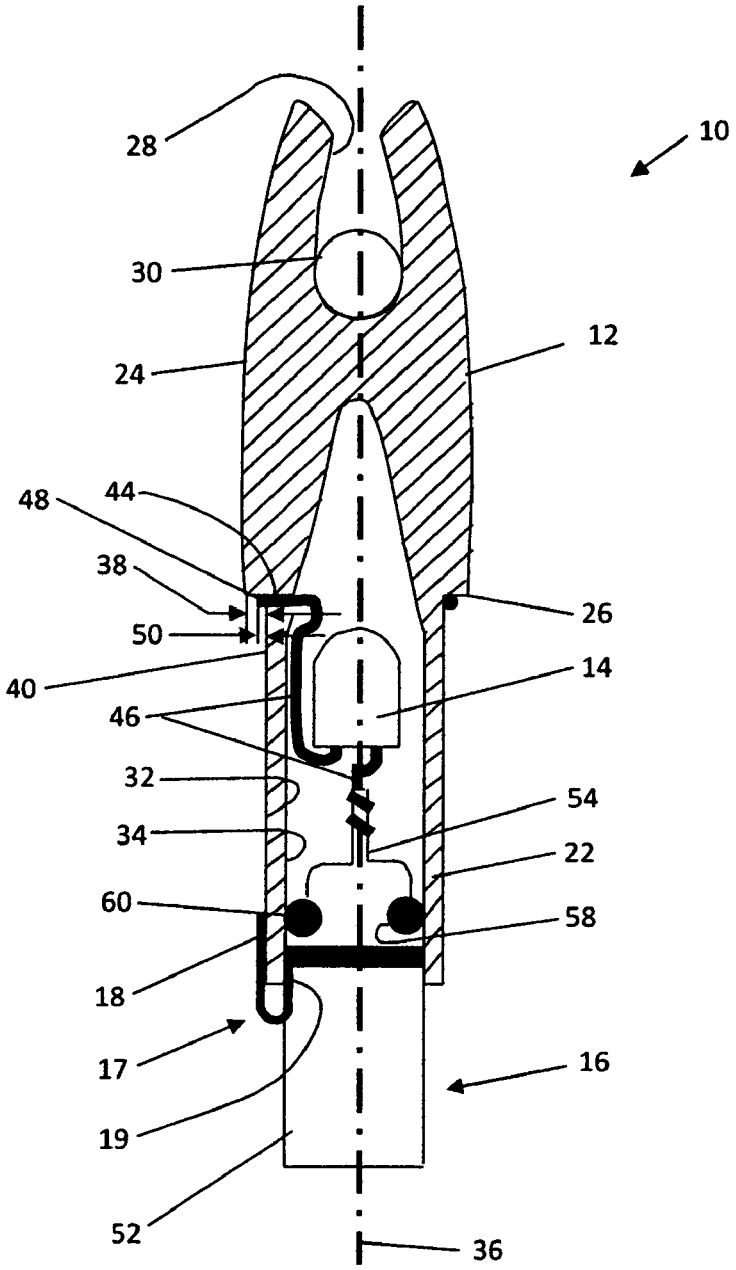
FIG. 1 is a diagrammatic partial cross-sectional view of a nock assembly embodying the present invention.
Figure 4:
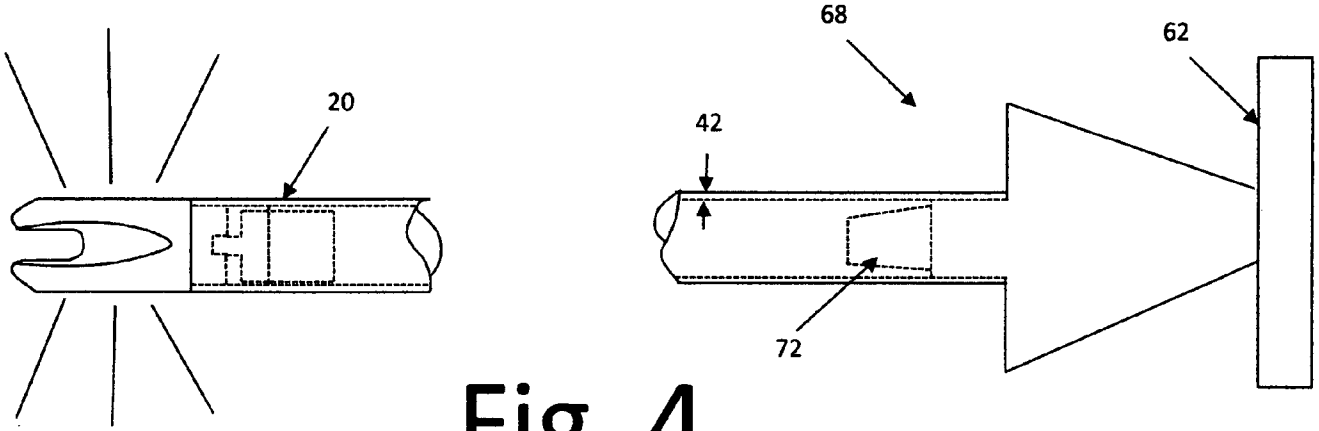
FIG. 4 is a diagrammatic partial cross-sectional view of the nock assembly and arrow upon impact embodying the present invention.
Figure 5:
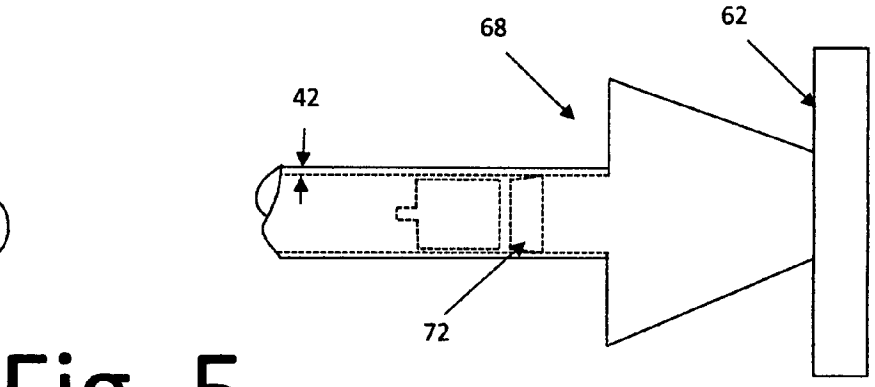
FIG. 5 is a diagrammatic partial cross-sectional view of the nock assembly and arrow upon hard impact embodying the present invention.

Turning to the drawings and particularly to FIG. 1, a partial cross-sectional view of a nock assembly (10) is shown in one embodiment of the present invention. As seen therein, the nock assembly (10) includes a nock (12), an illumination member (14), a power source (16), and a conductor (17). In the preferred embodiment, the nock (12) is made of a translucent material for transmitting light. The nock (12) may be made of composites, plastic, & the like without departing from the spirit of the invention. It should be recognized, to one skilled in the art, that nocks (12) made of non-translucent materials may be used as long as light is transmitted from the nock (12) without departing from the spirit of the invention. For example, a non-translucent material with apertures and/or passages formed in the nock (12) transmitting light from the illumination member (14) through the nock (12) may be used. The nock assembly (10) is used with an arrow shaft (20), as depicted in FIG. 4 and FIG. 5. The arrow shaft (20) is typically a tubular arrow shaft (20) that is electrically conductive. However, other configurations of the arrow shaft (20) may be used without departing from the spirit of the invention, such as, square, oval, and the like that are well known in the art. The electrically conductive arrow shaft (20) may be made of composites, metals, and the like without departing from the spirit of the invention.

The nock (12) includes a first nock portion (22), a second nock portion (24), and a step surface (26) located between the first and second nock portions (22, 24). The second nock portion (24) has a slot (28) disposed therein and the slot (28) positions a bowstring (not shown) in to the nock (12) for shooting the arrow shaft (20) at a target. The first nock portion (22) has a nock bore (32) defined by a curvilinear surface (34) and a longitudinal axis (36). It should be recognized that other nock bore (32) configurations may be used without departing from the spirit of the invention. For example, nock bores (32) may mirror the shape of the arrow shaft (20), such as, square, oval, and the like as previously discussed. The step surface (26) is of a first magnitude (38) measured from an outer surface (40) of the first nock portion (22) and is generally equal to or less in magnitude than a thickness (42) of the arrow shaft (20). At least one aperture (44) disposed in the first nock portion (22) is generally adjacent to the step surface (26) and open into the nock bore (32). The at least one aperture (44) is sized to accommodate the gauge of wire used with the illumination member (14) and conductor (17). It should be recognized, the at least one aperture (44) having curvilinear, square, slotted, and the like characteristics may be used without departing from the spirit of the invention.

Figure 3:
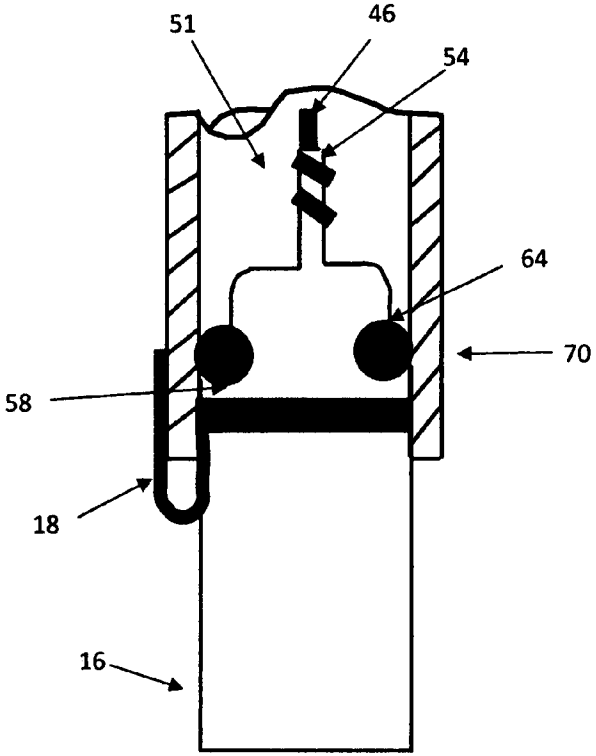
FIG. 3 is an exploded diagrammatic cross-sectional view of the power source retention upon impact of a nock assembly embodying the present invention.
Figure 2:
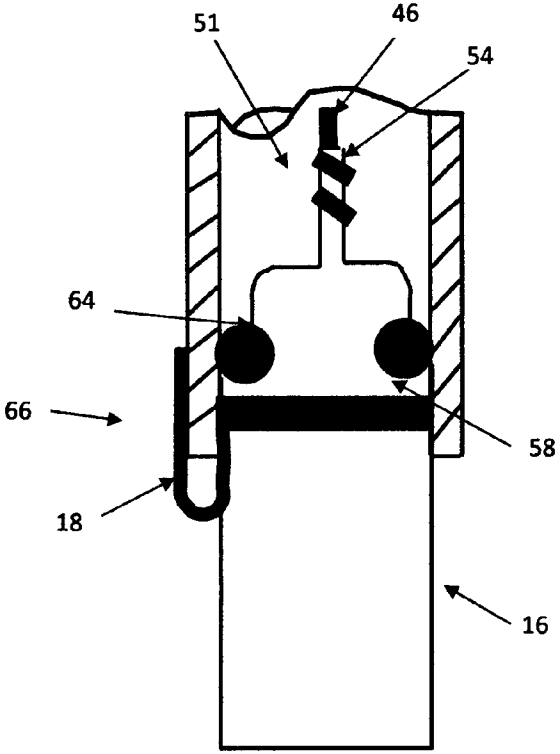
FIG. 2 is an exploded diagrammatic cross-sectional view of the power source retention embodying the present invention.

Referring to FIG. 1, the illumination member (14), such as, an LED, diode, light bulb, and the like is disposed in the nock bore (32). The illumination member (14) has a pair of leads (46) for connection to the power source (16). One of the pair of leads (46) extends through one of the at least one aperture (44) adjacent to the step surface (26). A first protruding portion (48) of one of the pair of leads (46) has a second magnitude (50) measured from the outer surface (40) of the first nock portion (22) and is generally equal to or less in magnitude than the first magnitude (38) of the step surface (26). The one of the pair of leads (46) that extends through one of the at least one aperture (44) generally wraps around the outer surface (40). Another of the pair of leads (46) is generally in a coiled configuration and will be discussed in greater detail below. As shown in FIG. 2 and FIG. 3, the pair of leads (46) is generally in a fixed position (51) relative to the nock (12). To one skilled in the art, the fixed position (51) may be achieved using adhesive, plastics, sealant, and etc. that are well known in the art.

Referring to FIG. 1, the power source (16) has a case (52) and a terminal (54). The power source (16) is typically a battery but other sources that are well known in the art may be used without departing from the spirit of the invention. The power source (16) is generally inserted into the first nock portion (22) until the terminal (54) engages, in electrical communication, with one of the pair of leads (46) which is generally in a coiled configuration. However, other configurations of one of the pair of leads (46) may be used without departing from the spirit of the invention—as long as there is electrical communication between the terminal (54) and one of the pair of leads (46) of the illumination member (14). For example, one of the pair of leads (46) may be fastened to a piece of conductive material that is formed to maintain a tight fir with the terminal (54). In addition, one of the pair of leads (46) that contacts the terminal (54) is held in position with an adhesive, such as, an electrically conductive polymer. To aid in retention of the power source (16) with the first nock portion (22) a groove (58) is generally disposed about the case (52). The groove (58) is generally sized to accept a resilient member (60). Upon insertion of the power source (16) into the first nock portion (22) the power source (16) generally engages the resilient member (60) with the nock bore (32). Typically, the resilient member (60) is characterized as an o-ring. However, other configurations that are well known in the art may be used without departing from the spirit of the invention. For example, a gasket, or a bead may be formed about the case. Furthermore, with the preferred embodiment, the case (52) has the groove (58) for retaining the resilient member (60). However, alternative embodiments, such as, using the resilient member (60) with the case (52) without the groove (58) or even inserting the power source (16) without the resilient member (60) may be used without departing from the spirit of the invention. Typically, configurations where the power source (16) is generally retained in the nock (12) upon general impact parameters from impact of the arrow shaft (20) with a target (62) may be used without departing from the spirit of the invention. In one embodiment, the grove further defines a shoulder portion (64). Upon insertion of the power source (16) into the nock bore (32), the resilient member (60) corresponds to an installed position (66). The installed position (66) is generally frictional engagement between the resilient member (60) and nock bore (32) and shoulder portion (64). In reference to FIG. 4, an arrow (68) impacts the target (62) transferring impact loads to the arrow shaft, as well as, the nock assembly. Impact of the arrow, corresponds to an impact position (70). The impact position (70) is generally compressed frictional engagement between the resilient member (6) and nock bore (32) and shoulder portion (64). The compressed frictional engagement generally retains the power source (16) upon typical impact forces. The impact position (70) is generally achieved upon impact of the arrow (68) which forces the shoulder portion (64) and groove (58) towards the resilient member (60). The resilient member (60) is generally compressed radially outward towards the nock bore (32). The power source (16) is generally in removable engagement with the nock (12). The removable engagement of the power source (16) with the nock allows the power source (16) to be replaced. Replacement of the power source (16) improves the life of the nock assembly (10) since the entire nock assembly (10) no longer needs to be replaced when the power source (16) becomes un-operable. In reference to FIG. 5, in some applications, an arrow (68) may come into contact with the target (62) which translates to high impact loads on the arrow shaft (20), as well as, the nock assembly (10). With past designs, the nock assembly (10), may become damaged and need premature replacement. With the instant invention, as described above, the power source (16) that has been inserted into the nock bore (32) disengages from high impact loads on the arrow shaft (20) and comes to rest within the arrow shaft (20). Once the user retrieves the arrow (68), the nock assembly (10) and the power source (16) may be removed from the arrow shaft (20). The user may reinsert the power source (16) into the arrow shaft (20) to make the nock assembly operable. To one skilled in the art, removable power source (16) upon high impact loads extends the life of the nock assembly (10) over past designs. In addition, referring to FIG. 4 and FIG. 5, to dampen the impact of the power source (16) after disengagement of the power source (16) from the nock (12) a resilient impact member (72) may be disposed in the arrow shaft (20). The resilient impact member (72) may be characteristic a light weight foam material capable of dampening the impact of the power source (16) with the arrow shaft (20).

Figure 1A:
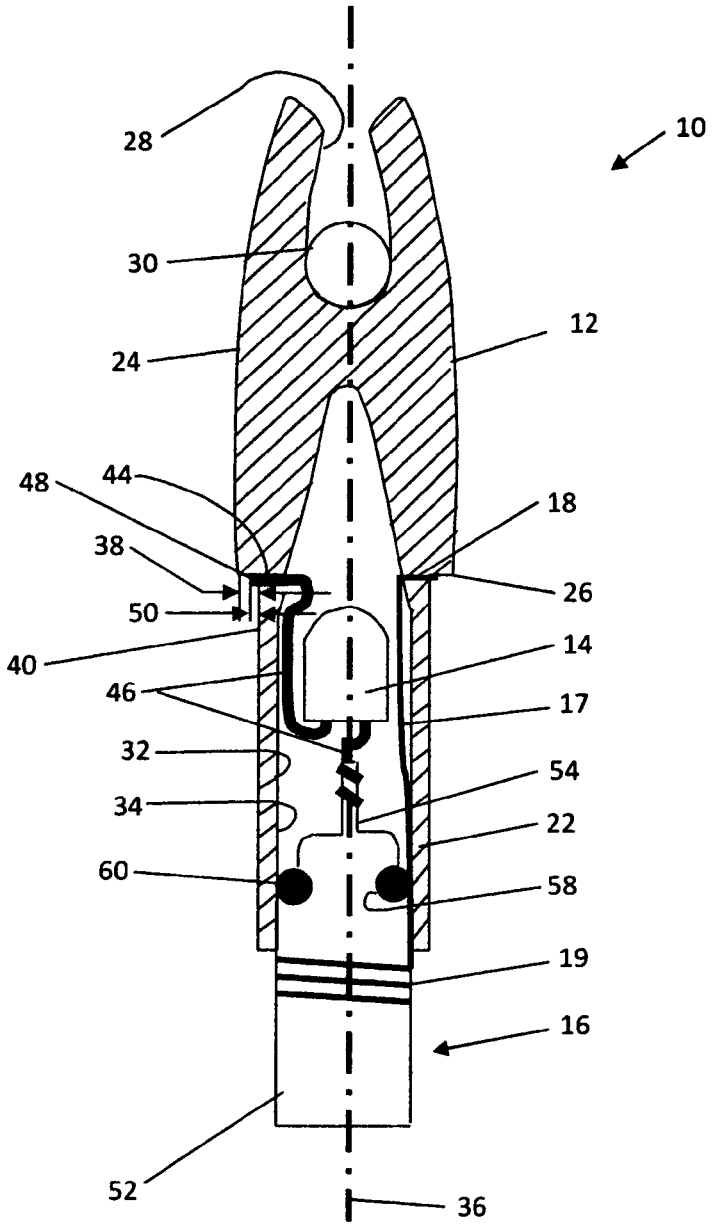
FIG. 1(A) is a diagrammatic partial cross-sectional view of a nock assembly embodying the present invention.

Referring to FIG. 1, the conductor (17), in one embodiment, is generally adjacent the case (52) and generally disposed between the case (52) and nock bore (32) upon insertion of the power source (16) into the first nock portion (22). The conductor (17) is in electrical communication with the case (52) and extends from the nock bore (32) to the outer surface (40) of the nock (12). The conductor (17) has a first end (18) that generally extends through the nock bore (32) to the outer surface (40) of the nock (12). Upon insertion of the nock assembly (10) into the arrow shaft (20) the first end (18) is in electrical communication with the arrow shaft (20). The conductor has a second end (19) generally positioned between the case (52) and the nock bore (32) and in electrical communication with the case (52). The conductor (17) completes an electrical circuit between the nock assembly (10) and the arrow shaft (20) upon shooting of the arrow (68). The conductor (17) is generally made of an electrical conductive material that is formable. For example light weight aluminum and the like may be used without departing from the spirit of the invention. In an alternative embodiment, shown in FIG. 1(A), the conductor (17) is formed of wire and the first end (18) generally extends through the nock bore (32) passing through another one of the at least one aperture (44) to the outer surface (40) of the nock (12). The second end (19) of the conductor (17) is adjacent the case (52) and is in electrical communication with the case (52). To enhance electrical communication between the second end (19) and the case (52) the wire may be coiled a number of turns to aid in contact between the wire and the case (52) and still permit the battery to be installed/removed from the nock (12).

The nock assembly (10) is shown with the arrow shaft (20). The first nock portion (22) is moveably extendable into the arrow shaft (20) along the longitudinal axis (36). The first nock portion (22) is generally in frictional engagement with the arrow shaft (20). The frictional engagement enhances the positioning characteristics of the nock assembly (10) with the arrow shaft (20). The first nock portion (22) is moveably extendable into the arrow shaft (20) spaces the step surface (26) from the arrow shaft (20) which corresponds to an open circuit between one of the pair of leads (46) and the conductor (17). The nock assembly (10) is typically spaced from the step surface (26) as the archer places the arrow shaft (20) in an aiming position (not shown). The first nock portion (22) is further moveably extendable into the arrow shaft (20) along the longitudinal axis (36) until engaging the step surface (26) with the arrow shaft (20) which corresponds to a closed circuit between one of the pair of leads (46) and the conductor (17) causing the illumination member (14) to illuminate. The step surface (26) is generally forcibly engaged with the arrow shaft (20) using the bowstring or force applied by the archer. However, engaging the step surface (26) with the arrow shaft (20) may be accomplished using fixed obstacles to movably extend the first nock portion (22). For example, using the ground to moveably extend the first nock portion (22) into the arrow shaft (20) may be used without departing from the spirit of the invention. Engagement of one of the pair of leads (46) and the arrow shaft (20) is accomplished by applying a force generally between 5 pounds and 30 pounds to the nock assembly (10). The force applied to moveably extend the step surface (26) sandwiches one of the pair of leads (46) between the step surface (26) and the arrow shaft (20). In the preferred embodiment, the illumination of the illumination member (14) is constant. However, variable illumination may be used without departing from the spirit of the invention. For example, multiple archers may use different rates of illumination, such as, blinking, brightness, and the like illumination to aid in identifying particular arrow shafts (20). It should also be recognized that archers may use different color for illumination, be it from nock material or illumination, to aid in recovering arrow shafts (20).

INDUSTRIAL APPLICABILITY

With reference to the Figs. and in operation, accuracy in the flight of the arrow shaft (20), recovery of the arrow shaft (20) after flight, rigidity of the nock assembly (10), life of the nock assembly (10) and the like are enhanced by using the nock assembly (10) with the removable power source (16). For example, adjustments with respect to arrow deflection as well as alignment of vanes, feathers, and arrow heads may be detected and corrected and improve the accuracy of arrow flight by using the nock assembly (10). The weight of the nock assembly (10) is generally similar to the weight of an archer's non-illuminating nock which allows the archer to minimize adjustments to archery equipment based on type of nock used during operation. Removal and replacement of the power source allows nocks to be r-used indefinitely and lowers cost to the user. High impact forces on the arrow (68) are minimized with disengagement of the power source (16) from the nock assembly (10). Further, the increase in rigidity of the nock assembly (10) enhances the useful life of the nock assembly (10).

In operation an archer inserts the nock assembly (10) into the arrow shaft (20) where the step surface (26) is spaced from the arrow shaft (20). The friction engagement between the first nock portion (22) and the arrow shaft (20) allows the archer to align the nock assembly (10) with the arrow shaft (20). Once the nock assembly (10) is aligned with the arrow shaft (20) the bowstring is positioned in the slot (28) of the nock assembly (10). The archer then draws the bowstring back to the aiming position (not shown). At this point, the step surface (26) of the nock assembly (10) is spaced from the arrow shaft (20) maintaining the open circuit between one of the pair of leads (46) and the conductor (17). The archer is able to take aim at the target with a non-illuminated nock assembly (10) allowing the archer to be unnoticed to the desired target. The archer releases the bowstring which in turn provides the necessary inertia force to movably extend the nock assembly into the arrow shaft (20) and engages the step surface (26) with the arrow shaft (20), i.e., sandwiches one of the pair of leads (46) with the arrow shaft (20) completing the closed circuit between one of the pair of leads (46) and the conductor (17). The nock assembly (10) in the closed circuit illuminates the illumination member (14). Once the arrow shaft (20) has completed flight the archer determines with the aid of the illuminated nock assembly (10) the spot where the arrow shaft (20) impacted and where the arrow shaft (20) comes to rest and retrieves the arrow shaft (20). The archer, with the illuminated arrow shaft (20), engages the nock assembly (10) and moveably extends the step surface (26) of the nock assembly (10) from the step surface (26) de-illuminates the nock assembly (10). It should be recognized that the archer may disengage the nock assembly (10) from the arrow shaft (20) without departing from the spirit of the invention. For example, archers who have completed their session using the arrow shaft (20) may store the nock assembly (10) separate from the arrow shaft (20).

The service of a nock assembly (10) for use with an electrically conductive tubular arrow (68). With the nock assembly (10) removed from the arrow (68), the archer, grasps the nock assembly (10) and the power source (16). The archer disengages the power source from the nock assembly. Typically disengagement is achieved my pulling the nock assembly (10) and power source (16) from one another. With the power source (16) removed from the nock assembly (10), the archer, inserts another power source (16) into the first nock portion (22) of the nock assembly (10).

Maintaining operation of a nock assembly (10) upon impact of the arrow (68) with the target (62). With the nock assembly (10) removed from the arrow (68), the archer, inserts the first nock portion (22) into the arrow shaft (20). Position the bowstring in the slot (28). The archer draws the bowstring to the aiming position (not shown) and releases the bowstring. The illuminated nock assembly (10) takes flight and impacts the arrow (68) with the target (62). Impact of the arrow (68) and target (62) compresses the resilient member (60) against the first nock portion (22) of the nock assembly (10). Under typical impacts the compression of the resilient member (60) retains the power source (16) with the nock assembly (10). In extreme applications, the impact of the arrow (68) and target (62) overcomes the compression of the resilient member (60) against the first nock portion (26) and the power source (16) disengages the power source (16) from the nock assembly (10). The disengaged power source (16) comes to rest within the arrow shaft (20) and may be aided with the resilient impact member (72) disposed in the arrow shaft (20) for dampening of forces on the power source (16) as the power source (16) comes to rest.

Other aspects, objects and advantages of this invention can be obtained from a study of the drawings, the disclosure and the appended claims.

The invention claimed is:

1. A nock assembly for use with an arrow, comprising:

a nock having a first nock portion, a second nock portion, and a step surface located between said first nock portion and said second nock portion, said first nock portion having a first end, a nock bore defined by a first curvilinear surface and a longitudinal axis, and at least one aperture disposed in said first nock portion generally adjacent to said step surface and opening into said nock bore;

a power source having a case generally engaging said first nock portion and a terminal, and said power source being in generally removable engagement with said nock;

an illumination member having a pair of leads, said illumination member being disposed in said nock bore, and one of said pair of leads extending through one of said at least one aperture and another of said pair of leads being in electrical communication with said terminal of said power source; and a conductor being in electrical communication with said case and extending from said nock bore to an outer surface of said nock.

2. The nock assembly for use with an arrow, as set forth in claim 1, wherein said case having a groove generally disposed about said case, said groove having a resilient member disposed therein, and said resilient member generally engaging said nock bore.

3. The nock assembly for use with an arrow, as set forth in claim 2, wherein said resilient member being an o-ring.

4. The nock assembly for use with an arrow, as set forth in claim 2, wherein said groove defines a shoulder portion.

5. The nock assembly for use with an arrow, as set forth in claim 4, wherein said resilient member having an installed position corresponding to a generally frictional engagement with said nock bore and said shoulder portion, and an impact position corresponding to a generally compressed frictional engagement with said nock bore and said shoulder portion.

6. The nock assembly for use with an arrow, as set forth in claim 5, wherein said impact position being generally achieved during impact of the arrow, said impact of the arrow forces said shoulder portion of said groove towards said resilient member and said resilient member being generally compressed radially outward towards said nock bore.

7. The nock assembly for use with an arrow, as set forth in claim 6, wherein said power source being retained in said nock upon impact of the arrow.

8. The nock assembly for use with an arrow, as set forth in claim 6, wherein said power source being disengaged from said nock upon impact of the arrow.

9. The nock assembly for use with an arrow, as set forth in claim 8, wherein the arrow having a resilient impact member being disposed therein and said power source generally engaging said resilient impact member upon impact of the arrow.

10. The nock assembly for use with an arrow, as set forth in claim 1, wherein said pair of leads being in a generally fixed position relative to said nock.

11. The nock assembly for use with an arrow, as set forth in claim 10, wherein said generally fixed position being achieved using adhesive.

12. The nock assembly for use with an arrow, as set forth in claim 1, wherein said conductor has a first end generally extending through said nock bore to said outer surface of said nock and a second end generally positioned between said case and said nock bore and in electrical communication with said case.

13. The nock assembly for use with an arrow, as set forth in claim 1, wherein said conductor has a first end generally extending through another one of said at least one aperture to said outer surface of said nock and a second end being in generally coiled configuration and in electrical communication with said case.

14. A method of maintaining operability of a nock assembly upon impact of an arrow with a target, said arrow having a tubular arrow shaft having a bowstring defining an aiming position and a resilient impact member disposed therein, and said nock assembly having a first nock portion, a second nock portion, a step surface located between said first and second nock portions, a slot defined therein, and a power source having a resilient member disposed thereabout, the method comprises the steps of;

Inserting said first nock portion into said arrow shaft;

Positioning said bowstring in said slot;

Drawing said bowstring to said aiming position;

Releasing said bowstring;

Impacting said arrow with said target; and

Compressing said resilient member against said first nock portion of said nock assembly.

15. A method of maintaining operability of a nock assembly upon impact of an arrow with a target, as in claim 14, wherein the step of compressing said resilient member disengages said power source from said nock assembly, and said power source impacting said resilient impact member.

* * * * *